US006974427B1

(12) United States Patent
Lapham

(10) Patent No.: US 6,974,427 B1
(45) Date of Patent: Dec. 13, 2005

(54) SPINAL AND SOFT TISSUE MOBILIZER

(76) Inventor: Roger Lapham, 8314 Fawn Terrace Ct., Houston, TX (US) 77071

( * ) Notice: Subject to any disclaimer, the term of this patent is extended or adjusted under 35 U.S.C. 154(b) by 105 days.

(21) Appl. No.: 10/277,775

(22) Filed: Oct. 22, 2002

(51) Int. Cl.[7] ..... A61H 15/00
(52) U.S. Cl. ..... 601/120; 601/135; D24/211
(58) Field of Search ..... 601/19, 115, 118, 601/119, 120–125, 128–129, 131–133, 135–138, 601/134; D24/211, 214

(56) References Cited

U.S. PATENT DOCUMENTS

| | | | | |
|---|---|---|---|---|
| 896,484 | A * | 8/1908 | Thoms | 601/120 |
| 4,416,271 | A | 11/1983 | Chester | |
| 4,712,539 | A | 12/1987 | Kim | |
| 4,785,800 | A | 11/1988 | Stilson | |
| 4,832,006 | A | 5/1989 | Kirsch | |
| 4,945,900 | A | 8/1990 | Masuda | |
| 5,170,778 | A | 12/1992 | Jamis | |
| 5,577,995 | A | 11/1996 | Walker et al. | |
| 5,577,996 | A | 11/1996 | Gardner et al. | |

FOREIGN PATENT DOCUMENTS

| | | | |
|---|---|---|---|
| DE | 4101971 A1 * | 8/1991 | A61H 15/00 |

* cited by examiner

*Primary Examiner*—Danton D. DeMille
*Assistant Examiner*—Quang D. Thanh
(74) *Attorney, Agent, or Firm*—Kenneth A. Roddy

(57) ABSTRACT

A spinal and soft tissue mobilizer of modular construction for physical therapy has an elongate generally spool-shaped roller with a reduced diameter mid portion and larger diameter teardrop-shaped outer end portions rollers that apply pressure to the thoracic vertebrae, rib cage and muscles of the back without directly contacting the vertebrae. The mid portion may have lateral rollers with laterally spaced larger diameter portions that straddle the vertebrae of the spine and apply pressure to the muscles surrounding the straddled vertebrae without directly contacting the vertebrae. Interchangeable spacers of various lengths may be installed between the lateral rollers and/or between the lateral rollers and the teardrop-shaped outer end portions to provide proper lateral spacing for a particular individual. An individual may use the device without assistance, by placing the device on the floor underneath his/her back and moving back and forth over the device, or an operator may grip the handles and roll the device up and down along the back and spinal area of an individual laying face down on a flat surface. The device may also be mounted horizontally in doorway whereby the user can move his or her back up and down while at the same time applying a reasonably constant force against the device.

11 Claims, 4 Drawing Sheets

SPINAL AND SOFT TISSUE MOBILIZER

BACKGROUND OF THE INVENTION

1. Field of the Invention

This invention relates generally to physical therapy apparatus for the spine, and more particularly to a spinal and soft tissue mobilizer having an elongate generally spool-shaped roller with a reduced diameter mid portion and teardrop-shaped outer end portions that apply pressure to the rib cage, thoracic vertebrae and muscles of the back of a user without directly contacting the vertebrae, and may have lateral rollers in the mid section that straddle the vertebrae of the spine and apply pressure to the muscles surrounding the straddled vertebrae without directly contacting the vertebrae.

2. Brief Description of Background Art

The anatomy of the spine is made up of three major sections: the cervical, the thoracic, and the lumbar spine. Below the lumbar spine is a bone called the sacrum, which is part of the pelvis. Each section is made up of individual vertebrae. There are 7 cervical vertebrae, 12 thoracic vertebrae, and 5 lumbar vertebrae.

The thoracic section is unique in that each of its 12 vertebrae attaches to a pair of ribs (12 on the left and 12 on the right). The thoracic vertebrae move with the ribs to form the rear anchor of the rib cage. The thoracic vertebrae have small depressions located on the centrum of the adjacent vertebrae known as demifacets that receive and articulate with the heads of the ribs, and costal facets located on the transverse process of the more posterior vertebra which articulate with the tubercle of the ribs. Because the thoracic vertebrae form relatively strong articulations with the ribs, they protect the thoracic spinal discs and facet joints from the wear and tear experienced by these structures in the other areas of the spine. However, this same characteristic results in the thoracic spine section having less mobility than that of the cervical and lumbar spine sections.

Like the other spinal vertebrae, the thoracic vertebrae act as attachments for muscles and ligaments in the mid spine and also encase and protect the median aspect of the spinal cord and thoracic nerve roots. Also like the adjoining vertebrae, the thoracic vertebrae and its adjacent ribs can misalign and biomechanically malfunction.

Common vertebral problems in the thoracic spine include vertebral subluxations, a condition where the vertebrae of the thoracic spine become statically misaligned and/or function abnormally resulting in pain, muscle spasm, and sometime nerve malfunction. Vertebrae that do not function properly within the spinal framework generate mechanical stress. This accelerates the wear and tear on the surrounding spinal muscles, ligaments, discs, joint and other spinal tissues. Pain, palpatory tenderness, inflammation, decreased spinal mobility, and muscle spasm and hypertonicity will eventually follow. Additionally, because of the direct mechanical and physiological relationship between the spinal column and the spinal nerve roots, vertebral subluxations as well as other spinal abnormalities have the potential to impair proper nerve functioning. Once nerve functioning is compromised, communication within the body becomes less effective jeopardizing the overall health and wellness of the individual.

When ribs "go out" or misalign in relation to their connecting vertebrae, the individual will often experience sharp pains in the area of the misaligned rib head, especially on twisting movements of the torso. A subluxated rib head (the posterior portion that attaches to the vertebrae which has lost its normal position and/or motion in relation to the vertebrae) will produce pain and increased pain upon breathing. Mid-back or thoracic pain is also commonly associated with postural problems. In today's society many people tend to hunch over a desk while reading, writing, or working on a computer. This causes forward head carriage and rounded shoulders, placing stress on the mid-back muscles (rhomboids and trapezius muscles).

Massage and physical therapy devices for the spine are known in the art. There are several patents that disclose massage and physical therapy devices having roller elements of various configurations rotatably mounted on a rod.

Gardner, U.S. Pat. No. 5,577,996 discloses a back massager comprising a shaft having opposite outer ends and a middle section. A pair of hollow resilient spheres, such as tennis balls, are mounted on the middle section of the shaft and rotate in conjunction with the shaft. The balls are movable in or out along the shaft as needed by applying sufficient axial force to slide them along the shaft axis.

Walker et al, U.S. Pat. No. 5,577,995 discloses a spinal and soft tissue mobilizer device that comprises two substantially solid spherical balls mounted on a shaft for independent rotation that provides a soft-yet-firm contact, like from the heel of the hand (fat and muscle over bone). In one embodiment, the balls have a spherical to elliptical configuration and comprise an inner ball portion of a variable density synthetic plastic material and with an outer covering or portion comprised of a flexible material. The balls have a confronting area forming a substantially elliptical shape extending from a major spherical ball portion. Another embodiment comprises two spherical rubber balls having an inner ball formed of hard material to assist in the mobilizing operation and an outer flexible rubber cover.

Jamis, U.S. Pat. No. 5,170,778 discloses a body pressure massaging device comprising a threaded cylindrical dowel on which is threadedly mounted a central narrow circular element having a shaped surface together with a pair of rounded end elements. A bell-shaped cap is threadedly mounted on the dowel on each side of the central narrow element so as to be positioned a specific distance from the central narrow element.

Masuda, U.S. Pat. No. 4,945,900 discloses a massage device having a pushing roller integrally formed of soft rubber rotatably mounted on a longitudinal shaft. The roller has first and second spherical body portions connected by a relatively small diameter portion with a plurality of small semi-spherical protrusions integrally formed in the exterior of the spherical body portions.

Kirsch, U.S. Pat. No. 4,832,006 discloses a massage apparatus having three removable interchangeable rollers of various shapes, each of one-piece construction, adapted to treat specific regions of the back which are mounted in laterally opposed notches in the side walls of a housing. The notches are located at a different distance above the base of the housing for supporting and positioning a treatment roller at a desired height above the base. Each of the treatment rollers differs from the other in configuration so that each roller is adapted to treat a specific pre-selected morphological region of the back.

Stilson, U.S. Pat. No. 4,785,800 discloses a device for relieving stress which is molded as a single solid device approximately 4¾" in length consisting of two spherical modules of urethane rubber 2½" in diameter joined together by a short solid urethane rubber shaft ½" in length. These dimensions are required for the device to fit in the saucers of the squama of the occipital bone of most users skulls.

Kim, U.S. Pat. No. 4,712,539 discloses a pressure applying apparatus having a mid-portion rotatably mounted on a shaft with inner disc-shaped rolling surfaces that are spaced apart specifically to provide a rolling surface for the neck. The mid-portion also has a second pair of larger disc-shaped rolling elements that are spaced outward from the inner rolling elements so as not to interfere with the function of the inner disk. The large rolling elements are spaced apart sufficiently to encompass the spine without touching it.

Chester, U.S. Pat. No. 4,416,271 discloses a doorway mounted spinal misalignment detective and corrective apparatus for the back. The invention is mounted on a vertically extending member such as a door jam and includes a base member with two wheels mounted for rotation on a horizontal axis. Support arms and a clamping mechanism connected to the base member removably hold the apparatus on the door jam.

The present invention is distinguished over the prior art in general, and these patents in particular by a spinal and soft tissue mobilizer for physical therapy which has an elongate generally spool-shaped roller with a reduced diameter mid portion and larger diameter teardrop-shaped outer end portions rollers that apply pressure to the thoracic vertebrae, rib cage and muscles of the back without directly contacting the vertebrae. The mid portion may have lateral rollers with laterally spaced larger diameter portions that straddle the vertebrae of the spine and apply pressure to the muscles surrounding the straddled vertebrae without directly contacting the vertebrae. Interchangeable spacers of various lengths may be installed between the lateral rollers and/or between the lateral rollers and the teardrop-shaped outer end portions to provide proper lateral spacing for a particular individual. An individual may use the device without assistance, by placing the device on the floor underneath his/her back and moving back and forth over the device, or an operator may grip the handles and roll the device up and down along the back and spinal area of an individual laying face down on a flat surface. The device may also be mounted horizontally in doorway whereby the user can move his or her back up and down while at the same time applying a reasonably constant force against the device.

SUMMARY OF THE INVENTION

It is therefore an object of the present invention to provide a spinal and soft tissue mobilizer having a spool-shaped mid portion with larger diameter truncated teardrop-shaped outer end rollers that apply pressure to the thoracic vertebrae, rib cage and muscles of the back without directly contacting the vertebrae.

It is another object of the present invention to provide a spinal and soft tissue mobilizer of modular construction having a mid portion that straddles the vertebrae of the spine and applies pressure to the muscles surrounding the straddled vertebrae without directly contacting the vertebrae and a pair of laterally spaced end rollers that apply pressure to the rib cage and muscles of the back.

Another object of this invention is to provide a spinal and soft tissue mobilizer of modular construction having laterally spaced rollers at its mid portion that straddle the vertebrae of the spine wherein the lateral spacing thereof can be selectively adjusted to provide proper lateral spacing for a particular individual.

Another object of this invention is to provide a spinal and soft tissue mobilizer of modular construction having laterally spaced rollers at its outer ends that apply pressure to the rib cage and muscles of the back wherein the lateral spacing thereof can be selectively adjusted to provide proper lateral spacing for a particular individual.

Another object of this invention is to provide a spinal and soft tissue mobilizer of modular construction having laterally spaced rollers at its mid portion that straddle the vertebrae of the spine and laterally spaced rollers at its outer ends that apply pressure to the rib cage and muscles of the back wherein the lateral spacing of the outer rollers relative to the mid-portion rollers can be selectively adjusted to provide proper lateral spacing for a particular individual.

A further object of this invention is to provide a spinal and soft tissue mobilizer of modular construction having laterally spaced rollers at its mid portion that straddle the vertebrae of the spine and laterally spaced rollers at its outer ends that apply pressure to the rib cage and muscles of the back, which may be used by an individual without assistance or may be manipulated by an operator to render physical therapy to an individual.

A still further object of this invention is to provide a spinal and soft tissue mobilizer of modular construction that may be used on a floor surface or may be supported horizontally in a doorway to render physical therapy to an individual without assistance.

Other objects of the invention will become apparent from time to time throughout the specification and claims as hereinafter related.

The above noted objects and other objects of the invention are accomplished by a spinal and soft tissue mobilizer for physical therapy which has an elongate generally spool-shaped roller with a reduced diameter mid portion and larger diameter teardrop-shaped outer end portions rollers that apply pressure to the thoracic vertebrae, rib cage and muscles of the back without directly contacting the vertebrae. The mid portion may have lateral rollers with laterally spaced larger diameter portions that straddle the vertebrae of the spine and apply pressure to the muscles surrounding the straddled vertebrae without directly contacting the vertebrae. Interchangeable spacers of various lengths may be installed between the lateral rollers and/or between the lateral rollers and the teardrop-shaped outer end portions to provide proper lateral spacing for a particular individual. An individual may use the device without assistance, by placing the device on the floor underneath his/her back and moving back and forth over the device, or an operator may grip the handles and roll the device up and down along the back and spinal area of an individual laying face down on a flat surface. The device may also be mounted horizontally in a doorway whereby the user can move his or her back up and down while at the same time applying a reasonably constant force against the device.

DESCRIPTION OF THE PREFERRED EMBODIMENTS

Figure 1:
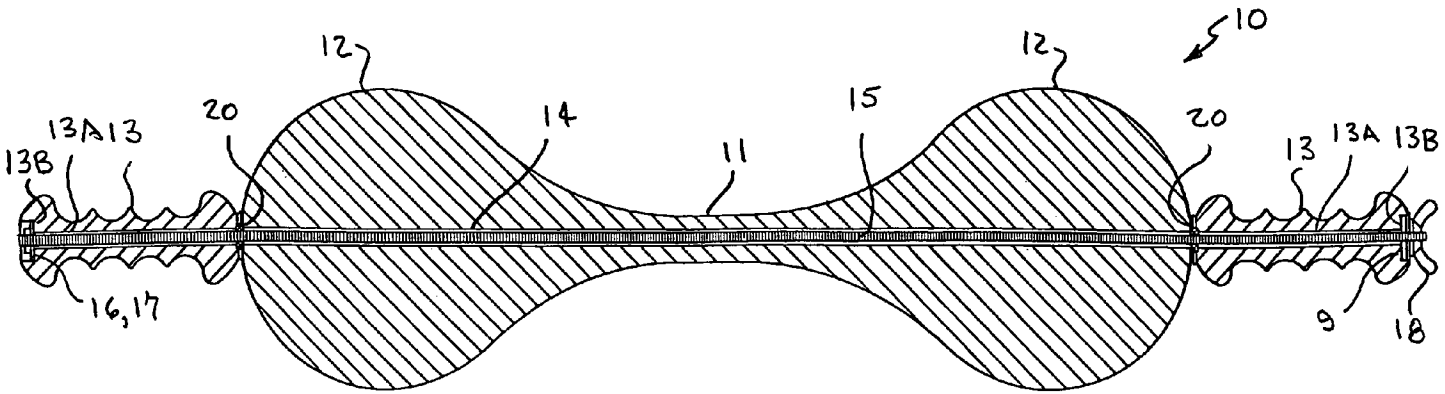
FIG. 1 is a longitudinal cross section of a first embodiment of the spinal and soft tissue mobilizer device in accordance with the present invention.

Referring to FIG. 1 of the drawings by numerals of reference, there is shown a spinal and soft tissue mobilizer device 10, in accordance with a first embodiment of the present invention. The device 10 has a elongate roller having a spool-shaped mid-portion 11 with a pair of teardrop-shaped outer end portions 12 disposed at opposite ends of the mid-portion, and a pair of handles 13 disposed at opposite ends of the outer end portions. A central longitudinal bore 14 extends through the center of the spool-shaped mid-portion 11 and teardrop-shaped outer end portions 12.

In the embodiment of FIG. 1, the elongate roller is a unitary roller and the spool-shaped mid-portion 11 and teardrop-shaped outer end portions 12 are integrally formed along the length thereof. The spool-shaped mid portion 11 curves laterally outward and upward from a reduced diameter center section in a contiguous concave gradual curve adjoining the smaller end potions of the teardrop-shaped outer end portions 12 and extending to the larger outer diameter of the teardrop-shaped outer end portions.

Figure 3:
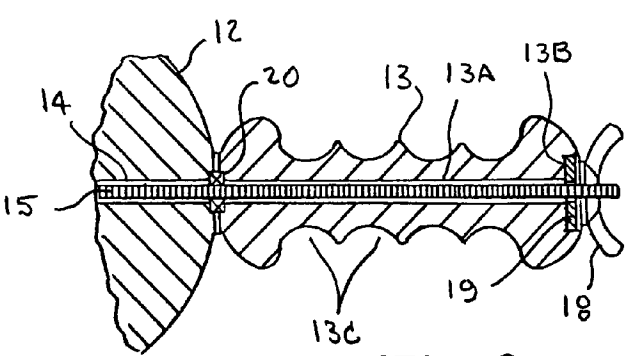
FIGS. 2 and 3 are partial longitudinal cross sections through the handle portion at respective laterally opposed ends of the device.
Figure 2:
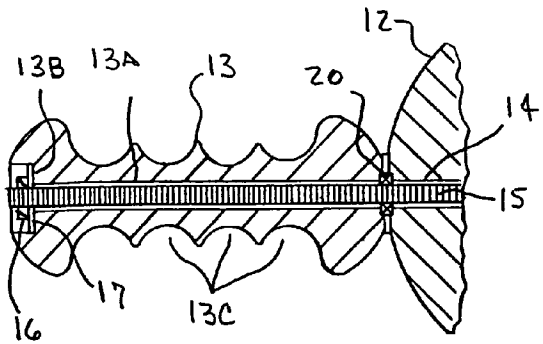
Figure 4:
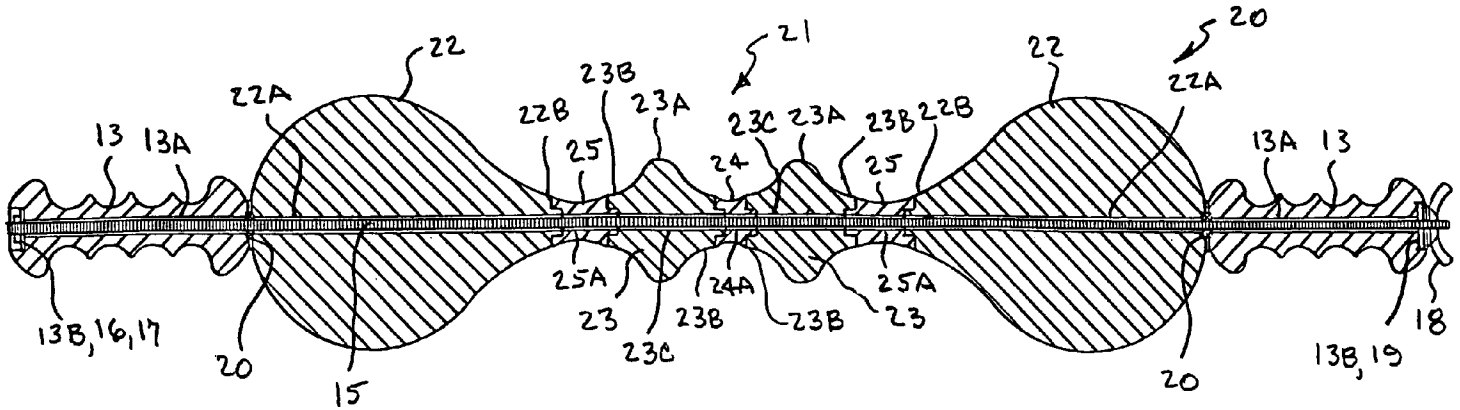
FIG. 4 is a longitudinal cross section of a second embodiment of the device with a segmented mid portion having spool-shaped roller segments that straddle the vertebrae of the spine and spacers installed between the rollers.
Figure 5:
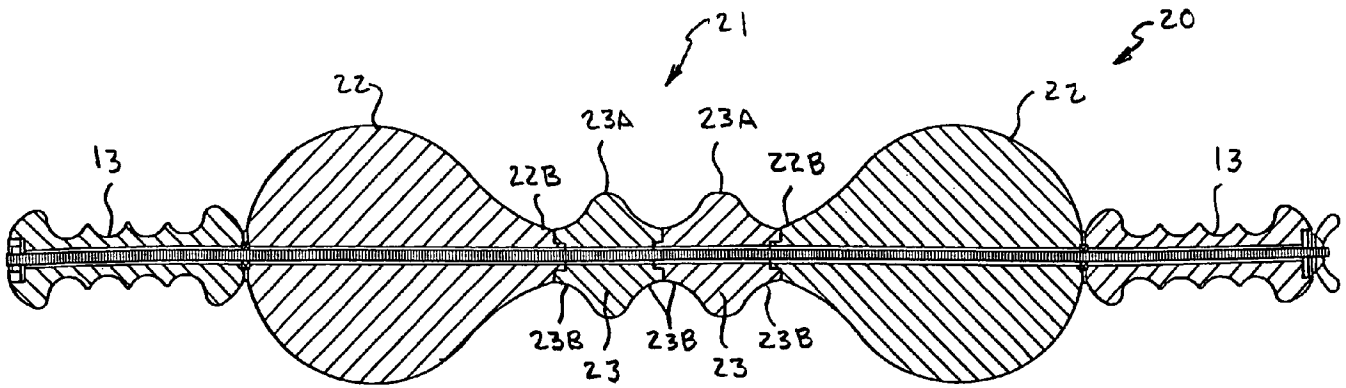
FIG. 5 is a longitudinal cross section of the embodiment of FIG. 4 with the spacer elements removed.

As best seen in FIGS. 3 and 4, each of the handles 13 has a central bore 13A and a counterbore 13B in their outer end. An elongate rod 15 extends through the central bore 14 of the spool-shaped mid-portion 11 and outer end portions 12, and bore 13A in the handles 13. The rod 15 may be externally threaded along its length, or have threaded outer end portions at its opposed ends. A nut 16 and washer 17 are installed on one threaded end of the rod 15 and are disposed in the counterbore 13B of one handle 13. A wing nut 18 and washer 19 are installed on the opposed threaded end of the rod 15 and are received partially in the counterbore 13B of the other handle 13. Thrust washers or bearings 20 are installed on the rod 15 between the inner facing ends of the handles 13 and the larger outer facing ends of the teardrop-shaped outer end portions 12, such the spool-shaped mid-portion 11 and teardrop-shaped outer ends 11 can rotate relative to the handles 13. The handles 13 are preferably provided with parallel circumferential grooves 13C sized and rounded to accommodate the fingers of the user to facilitate gripping.

The reduced diameter center section of the mid-portion 11 is sufficiently small and the outer diameter of the teardrop-shaped outer end portions 12 are sufficiently greater than the reduced diameter section and laterally spaced relative thereto such that the mid portion does not contact the vertebrae of the spine of a user when the outer diameter of the teardrop-shaped outer end portions are engaged with the lateral rib cage area on the back of the user, as described hereinafter.

In a preferred embodiment, the spool-shaped mid-portion 11 and outer end portions 12 are formed of hard material, such as wood, plastic or hard rubber. It should be understood that the components need not be of solid cross section, but may be provided with the same outer profile described herein but having interior structural ribs or posts to reduce weight and facilitate manufacture by a molding process.

Referring to FIG. 4, there is shown a second embodiment of the spinal and soft tissue mobilizer device 20, having a segmented mid portion 21, a pair of truncated teardrop-shaped outer end segments 22 disposed at opposite ends of the mid-portion, and a pair of handles 13 disposed at opposite ends of the outer end segments. In this embodiment, the spool-shaped mid-portion 21 is formed of a pair of lateral rollers 23 each having a larger diameter center portion 23A, smaller diameter laterally opposed ends 23B, and a central bore 23C. The teardrop-shaped outer end segments 22 have a central bore 22A, and smaller diameter truncated ends 22B, which are approximately the diameter as the smaller diameter ends 23B of the lateral rollers 23.

In the embodiment of FIG. 4, a short center spacer 24 having a central bore 24A is installed between the facing smaller diameter ends 23B of the lateral rollers 23. The laterally opposed ends of the center spacer 24 have an outer diameter approximately the same, or smaller, than the smaller diameter ends 23B of the rollers 23. The purpose of the center spacer 24 is to space the larger diameter center portions 23A of the lateral rollers 23 a predetermined distance laterally apart, as explained hereinafter.

A pair of second short lateral spacers 25, each having a central bore 25A, are installed between the outer facing smaller diameter ends 23B of the rollers 23 and the truncated ends 22B of the teardrop-shaped outer end members 22. The laterally opposed ends of the lateral spacers 25 have an outer diameter approximately the same, or smaller, than the smaller diameter ends 23B of the lateral rollers 23. The purpose of the lateral spacers 25 is to space the larger diameter teardrop-shaped outer end segments 22 a predetermined distance apart, as explained hereinafter.

The handles 13 have a central bore 13A and a counterbore 13B in their outer ends. A rod 15, as described above, extends through the central bores of the rollers 23, truncated teardrop-shaped outer end segments 22, and spacers 24 and 25. A nut 16 and washer 17 is installed on one end of the rod 15 and are disposed in the counterbore 13B of one handle 13. A wing nut 18 and washer 19 are installed on the opposed end of the threaded rod 15 and are received partially in the counterbore 13B of the other handle 13. Thrust washers or bearings 20 are installed on the rod 15 between the inner facing ends of the handles 13 and the larger diameter outer facing ends of the teardrop-shaped outer end segments 22, such all of the components can rotate relative to the handles. Optionally, the truncated ends of the teardrop-shaped segments and one end of each of the spacers and rollers may be provided with a protrusion, and the opposite ends of each of the spacers and roller provided with a recess to facilitate adjoining the components and rotation as a unit.

The larger diameter center portions 23A of the lateral rollers 23 have an outwardly rounded periphery. The center spacer 24 and the larger diameter center portions 23A of the lateral rollers 23 forming the spool-shaped mid-portion 21 are dimensioned such that the larger diameter center portions 23A straddle the vertebrae of the spine and apply pressure to the muscles surrounding the straddled vertebrae without directly contacting the vertebrae. In order to achieve the proper lateral spacing for a particular individual, the spacer 24 may be eliminated or interchangeable spacers of different lengths may be provided.

The lateral spacers 25 are dimensioned such that the larger diameter outer end segments 22 are disposed a distance laterally outward from the vertebrae of the spine and apply pressure to the rib cage and muscles of the back. In order to achieve the proper lateral spacing for a particular individual, the lateral spacers 25 may be eliminated or interchangeable lateral spacers of different lengths may be provided. The interchangeable spacers 25 also allow the lateral spacing of the outer teardrop-shaped segments 22 relative to the mid-portion lateral rollers 23 to be selectively adjusted to provide proper lateral spacing for a particular individual. FIG. 3 shows an embodiment of the device 20 with the spacers removed.

In a preferred embodiment, the lateral rollers 23, the teardrop-shaped outer end segments 22 and the spacers 24 and 25 are formed of hard material, such as wood, plastic or hard rubber. It should be understood that the larger components need not be of solid cross section, but may be provided with the same outer profile described herein but having interior structural ribs or posts to reduce weight and facilitate manufacture by a molding process.

The roller device 10 or 20 of the present invention can be used several ways either by the individual or by another operator. For example, an individual may use the device 10 or 20 without assistance, by placing the device on the floor underneath his/her own back and moving back and forth over the device, or an operator may grip the handles 13 and roll the device up and down along the back and spinal area of an individual laying face down on a flat surface.

Figure 6:
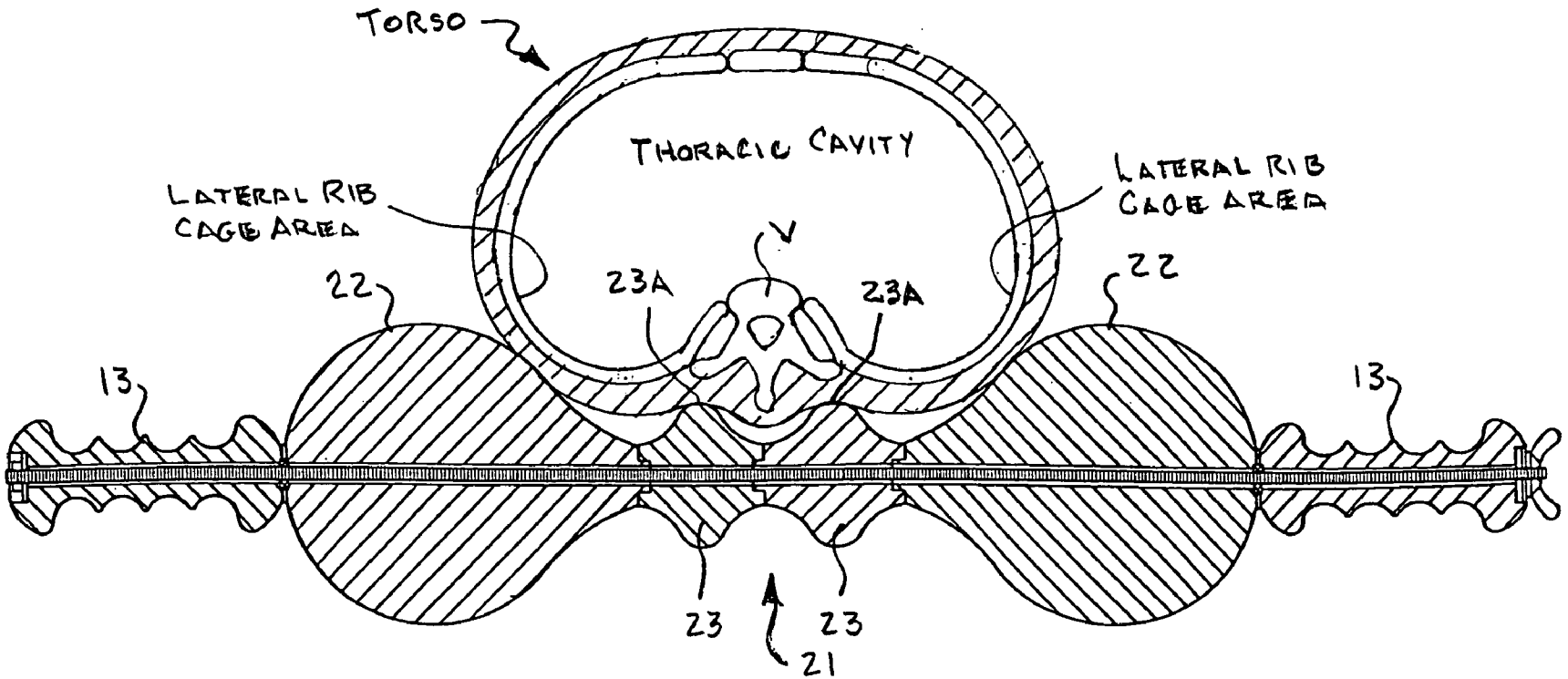
FIG. 6 is a longitudinal cross section of the embodiment of FIG. 5 with the spacer elements removed, shown in place against the back of a user, with the thoracic cavity shown somewhat schematically.

As shown somewhat schematically in FIG. 6, the outer diameter 23 of the lateral rollers 23 straddle the spine and vertebrae V and apply pressure to the muscles surrounding the straddled vertebrae without directly contacting the vertebrae. The significantly larger diameter teardrop-shaped segments 22 engage the lateral rib cage area for optimal mobilization of the areas about the spine, and the facet joints of the spine. Relative movement between the upper torso and the larger diameter teardrop-shaped segments 22 applies pressure to the lateral rib cage area and underlying tissue and muscles and consequently flexure of the ribs causes articulation and flexing of the thoracic vertebrae.

Figure 7:
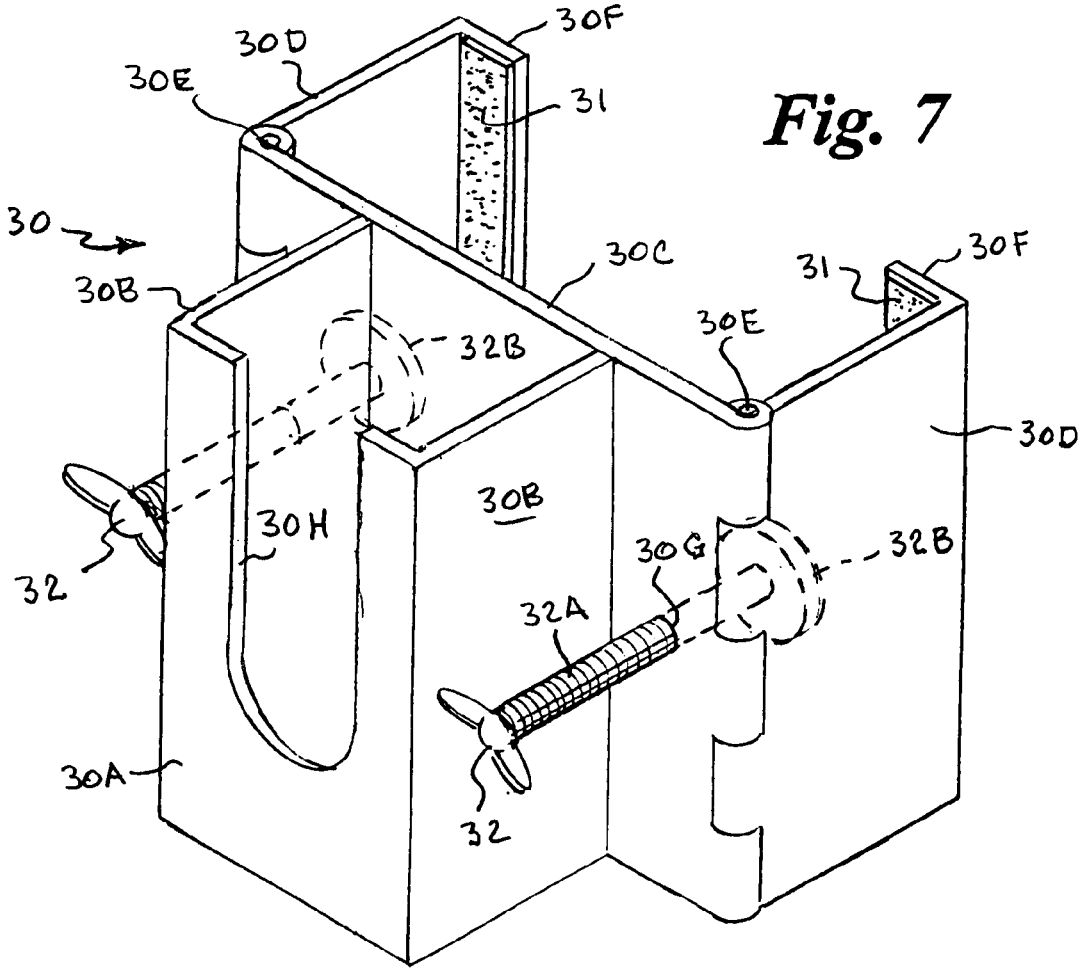
FIG. 7 is a perspective view of a bracket for supporting the device horizontally in a doorway.
Figure 8:
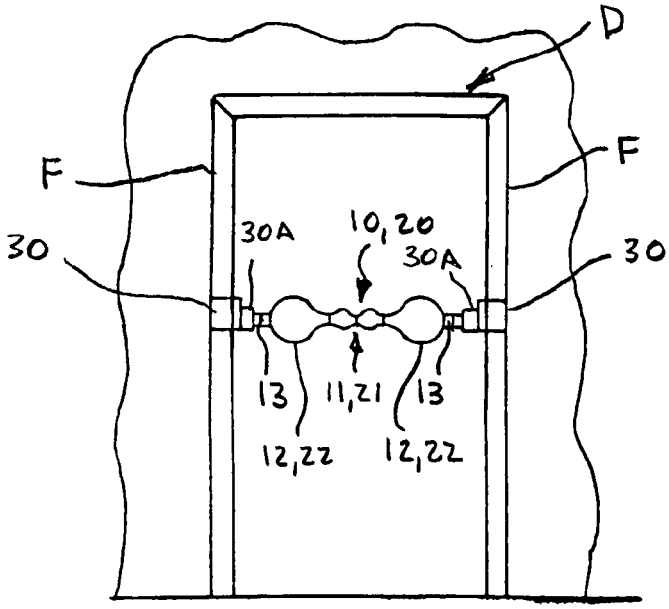
FIG. 8 is an elevation view showing the device supported horizontally in a doorway.

As shown in FIGS. 7 and 8, a pair of brackets 30 may be provided that can be installed in an interior doorway of a home or office building for removably supporting the device 10 or 20. A conventional interior doorway D typically has a pair of vertical frame members F on both lateral sides of the doorway opening that extend along the walls surrounding the doorway opening.

Each bracket 30 is a generally rectangular member having a first generally U-shaped front portion with a front wall 30A and lateral sides 30B that extend a distance rearwardly and adjoin a wider generally U-shaped portion having a front wall 30C with generally L-shaped lateral sides 30D adjoined thereto by a hinge connection 30E. The inward facing surface of the shorter leg 30F of each lateral side 30D may have a resilient pad 31 secured thereon. A threaded bore 30G extends through the front wall 30C on each side of the lateral sides 30B of the front portion. The shank 32A of a thumbscrew 32 extends through each threaded bore 30G, respectively, and has a padded disk 32B mounted on one end by a conventional ball joint connection. The distance between the inward facing surfaces of the shorter legs 30F of the lateral sides 30D and the padded disks 32B, when the thumbscrews 32 are retracted, is greater than the width of the doorjamb and frame. The front wall 30A has a vertical U-shaped slot 30H sized to receive and support the outer end portion of the handle 13 of the device 10 or 20.

Each bracket 30 is installed by pivoting its L-shaped sides 30D outwardly to clear the doorjamb and vertical frame members F, then pivoting them inward over the vertical frame members, and then tightening the thumbscrews 32 such that the pad 31 on the inward facing surface of the shorter leg 30F of each lateral side 30D is engaged on the outer facing raised edge of the frame member F, and the padded disk 32B of the thumbscrew 32 clamp and grip the vertical frame members, similar to a C-clamp. After initial installation, the brackets 30 are adjusted so that they are horizontally aligned at the desired height by loosening the thumbscrews 32 and moving the brackets up or down and then re-tightening them to secure the brackets in place.

After the brackets 30 are secured in place at the desired height above the floor, the roller device 10 or 20 is supported horizontally between the brackets by placing the outer end portions of the handles 23 into the U-shaped slots 30H of the brackets. The user backs up to the roller device 10 or 20 and positions his or her spine at the midportion 11 or 21 between the two larger diameter teardrop-shaped ends 12 or 22. The user then moves his or her back up and down while at the same time applying a reasonably constant force against the mid portion 11 or 21 and the larger diameter teardrop-shaped outer segments 12 or 22. The up and down motion of the user can be achieved by bending at the knees and/or by raising the heels of the feet.

While this invention has been described fully and completely with special emphasis upon preferred embodiments, it should be understood that within the scope of the appended claims the invention may be practiced otherwise than as specifically described herein.

What is claimed is:

1. A spinal and soft tissue mobilizer device for physical therapy and mobilization of the areas about the spine, and the facet joints of the spine of a human user, comprising:

an elongate rod having a longitudinal axis and opposed outer ends;

a pair of handles mounted on respective said opposed outer ends of said rod;

an elongate generally spool-shaped segmented roller assembly rotatably mounted on said rod between said handles, said roller assembly having a reduced diameter mid-portion and a pair of laterally opposed generally teardrop-shaped outer end segments at opposite ends thereof each having a larger diameter outer facing spherical end;

bearing means on said rod disposed between inner facing ends of said handles and said outer facing spherical ends of said generally teardrop-shaped outer end segments, whereby said segmented roller assembly rotates about the longitudinal axis of said rod relative to said handles and said rod;

said reduced diameter mid-portion comprising a pair of lateral roller segments, each having laterally opposed first and second ends of a smaller diameter that curve inwardly and upwardly into a larger diameter annular center portion, said first ends of said lateral roller segments disposed in face to face relation; and said generally teardrop-shaped outer end segments each having a truncated smaller diameter end disposed in face to face relation with a said smaller diameter second end of a respective one of said lateral roller segments that curves outwardly and upwardly into its said larger diameter outer facing spherical end;

said larger diameter annular center portions of said lateral roller segments being laterally spaced apart by said first ends thereof a sufficient distance to straddle the vertebrae of the spine of the user and said first ends thereof are of sufficiently smaller diameter so as not to contact the vertebrae of the spine; and said larger diameter of each of said teardrop-shaped outer end segments being sufficiently greater than said larger diameter annular center portions of said lateral roller segments and disposed a sufficient distance laterally outward therefrom to engage the lateral rib cage area the user; such that upon application of pressure and relative movement between the back along the spine and lateral rib cage area of the user, said annular center portions of said lateral roller segments straddle the user's spine and vertebrae without direct contact with the vertebrae and said larger diameters of said teardrop-shaped end segments engage and apply pressure to the user's lateral rib cage area, back muscles and underlying tissue for mobilization of the areas about the spine and the facet joints of the spine, and relative movement between the user's upper torso and said teardrop-shaped end segments applies pressure to the lateral rib cage area and consequent flexure of the ribs causes articulation and flexing of the thoracic vertebrae.

2. The spinal and soft tissue mobilizer device according to claim 1, wherein said first ends of said lateral roller segments are adjoined face to face, and said second ends thereof are adjoined face to face with said truncated smaller diameter end of a respective one of said teardrop-shaped segments.

3. The spinal and soft tissue mobilizer device according to claim 1, further comprising:

a center spacer segment having a reduced diameter center section and laterally opposed outer ends disposed between said first ends of said lateral roller segments; wherein said larger diameter annular center portions of said lateral roller segments are laterally spaced apart by said center spacer segment a sufficient distance to straddle the vertebrae of the user's spine and said reduced diameter center section of said center spacer segment is of a diameter sufficiently small so as not to contact the vertebrae of the spine.

4. The spinal and soft tissue mobilizer device according to claim 3, wherein said center spacer segment is a spool-shaped spacer having laterally opposed outer ends of a larger outer diameter and said reduced diameter center section is curved laterally outward and upward and terminating in said laterally opposed outer ends of a larger outer diameter.

5. The spinal and soft tissue mobilizer device according to claim 3, wherein said laterally opposed outer ends of said center spacer segment are adjoined to said first ends of said lateral roller segments, and said second ends of said lateral roller segments are adjoined to a said truncated smaller diameter end of a respective one of said teardrop-shaped segments.

6. The spinal and soft tissue mobilizer device according to claim 1, further comprising:

a pair of lateral spacer segments each having a reduced diameter center section and laterally opposed outer ends;

each of said lateral spacer segments disposed between a respective one of said second ends of said lateral roller segments and a said truncated smaller diameter end of a respective one of said teardrop-shaped segments; wherein said larger diameter outer facing spherical ends larger of said teardrop-shaped segments are laterally spaced apart by said lateral spacer segments a sufficient distance to apply pressure to the user's lateral rib cage area.

7. The spinal and soft tissue mobilizer device according to claim 1, wherein each of said lateral spacer segments is a spool-shaped spacer having laterally opposed outer ends of a larger outer diameter and said reduced diameter center section is curved laterally outward and upward and terminating in said laterally opposed outer ends of a larger outer diameter.

8. The spinal and soft tissue mobilizer device according to claim 6, wherein one of said laterally opposed outer ends of each said lateral spacer segments is adjoined to a said second end of a respective one of said lateral roller segments, and the other one of said opposed outer ends of each of said lateral spacer segments is adjoined to a said truncated smaller diameter end of a respective one of said teardrop-shaped segments.

9. The spinal and soft tissue mobilizer device according to claim 1, further comprising:

a center spacer segment having a reduced diameter center section and laterally opposed outer ends disposed between said first ends of said lateral roller segments; and a pair of lateral spacer segments each having a reduced diameter center section and laterally opposed outer ends, and each of said lateral spacer segments disposed between a respective one of said second ends of said lateral roller segments and a said truncated smaller diameter end of a respective one of said teardrop-shaped segments; wherein said larger diameter annular center portions of said lateral roller segments are laterally spaced apart by said center spacer segment a sufficient distance to straddle the vertebrae of the user's spine and said reduced diameter center section of said center spacer segment is of a diameter sufficiently small so as not to contact the vertebrae of the spine; and said larger diameter outer facing spherical ends of said teardrop-shaped segments are laterally spaced apart by said lateral spacer segments a sufficient distance to apply pressure to the user's lateral rib cage area.

10. The spinal and soft tissue mobilizer device according to claim 9, wherein said center spacer segment and each of said lateral spacer segments is a spool-shaped spacer having laterally opposed outer ends of a larger outer diameter and said reduced diameter center section is curved laterally outward and upward and terminating in said laterally opposed outer ends of a larger outer diameter.

11. The spinal and soft tissue mobilizer device according to claim 9, wherein said laterally opposed outer ends of said center spacer segment are adjoined to said first ends of said lateral roller segments, and said second ends of said lateral roller segments are adjoined to a said truncated smaller diameter end of a respective one of said teardrop-shaped segments; and one of said laterally opposed outer ends of each said lateral spacer segments is adjoined to a said second end of a respective one of said lateral roller segments, and the other one of said opposed outer ends of each of said lateral spacer segments is adjoined to a said truncated smaller diameter end of a respective one of said teardrop-shaped segments.

* * * * *